United States Patent [19]

Wittnebel et al.

[11] 4,055,422

[45] Oct. 25, 1977

[54] ADDITIVE FOR INHIBITOR REMOVING BATH

[75] Inventors: Bruce W. Wittnebel; R. Dean Lowrey, both of St. Paul, Minn.

[73] Assignee: Minnesota Mining and Manufacturing Company, St. Paul, Minn.

[21] Appl. No.: 599,639

[22] Filed: July 28, 1975

[51] Int. Cl.[2] ..... G03C 7/16; G03C 5/32; G03C 5/30

[52] U.S. Cl. ..... 96/22; 96/60 R; 96/66.2

[58] Field of Search ..... 96/22, 60 R, 66.2

[56] References Cited

U.S. PATENT DOCUMENTS

| | | | |
|---|---|---|---|
| 2,686,718 | 8/1954 | Schwarz | 96/66.2 |
| 2,825,647 | 3/1958 | Fuller | 96/66.2 |
| 2,893,865 | 7/1959 | Welliver et al. | 96/66.2 |
| 3,246,987 | 4/1966 | Hanson, Jr. et al. | 96/59 |
| 3,554,748 | 1/1971 | Bard et al. | 96/22 |
| 3,779,767 | 12/1973 | Hasegawa et al. | 96/22 |
| 3,883,354 | 5/1975 | Molenda | 96/22 |

OTHER PUBLICATIONS

McCready et al., Colorimetric Determination, 10/25/72 -Carbohydrate Research vol. 28, pp. 100–102.

*Primary Examiner*—David Klein
*Assistant Examiner*—L. Falasco
*Attorney, Agent, or Firm*—Cruzan Alexander; Donald M. Sell; Mark A. Litman

[57] ABSTRACT

The addition of either a borohydride or borane complex anhydrously associated with an aldose to an inhibitor removing bath which does not contain a color reverse agent improves color balance and contributes color agent to the bath. Addition of these anhydrously associated materials avoids possible decomposition in premixed solutions.

7 Claims, No Drawings

ADDITIVE FOR INHIBITOR REMOVING BATH

The present invention relates to photographic color development technology, and more particularly relates to a color reversal monobath and a process for its use, and to photographic kits adapted to prepare such monobaths.

A widely used process for reversal color development of silver halide photographic films employs a succession of baths through which exposed photographic films must be passed. For example, a first bath may include a black and white developing agent which reduces silver halide in latent image areas of a film to silver, forming negative silver image therein. Thereafter the film may be uniformly exposed to light to form fog centers in undeveloped areas of the film, and then treated with a color developer solution in which a color developing agent reduces silver halide in the fogged areas to silver, and is itself oxidized. The oxidation product of the developer reacts with one or more color couplers which may be distributed throughout various layers of the film to form dyes therein. The silver images may then be bleached from the film, and unreacted silver halide may be removed therefrom by "fixing" to thus provide positive, colored images. To avoid cross-contamination of the various processing baths, a number of intermediate wash baths are commonly employed. Further, a "stop" bath is ordinarily utilized to halt black and white developement immediately after treatment of the film in the black and white developer bath.

As will be evident from the above description, the process described employs many steps and utilizes many different processing baths. In addition, the shelf-life of these prepared solutions is poor. Further, the above procedure must be very carefully regulated in order to provide satisfactory photographic color reproductions. Moreover, the time which is required to fully process an exposed roll of color film (a major cost factor) is inordinately long. A faster, more efficient, lessdetailed positive color development process is hence much to be desired.

U.S. application Ser. No. 280,263 filed 1972 discloses an alternative photographic color reversal development process which comprises:

A. treating a color photographic element having a hydrophilic colloid silver halide layer bearing a latent image with an aqueous bath solution which includes at least 0.20 moles/liter of photographic color developing agent capable, upon oxidation, of reacting with a photographic color coupler to form a dye, black and white photographic developer including at least one black and white developing agent having a polarographic half-wave potential at pH 10.0 of from about -10 millivolts to about -187 millivolts, and water-soluble dye-formation inhibitor in a concentration of at least 0.10 moles/liter, said concentration being sufficient so that substantially all dye formation of a silver halide photographic element is restrained in said bath after said element has been exposed to the light, the mole ratio of inhibitor to color developer being at least about 0.97, thereby to imbibe said silver halide layer with said bath solution and to develop solely a negative black and white image therein;

B. thereafter fogging said silver halide layer so as to render said layer developable in non-imaged areas;

C. without intermediate removal of said imbibed bath solution, treating said layer to reduce the inhibiting effect of said dye formation inhibitor; and D. allowing development therein of a positive color image in the presence of a color coupler.

It is desirable in the practice of the above described new process to supply the chemistry for the process in kit form so that it may readily be used by the public. However, when photographic chemistry is pre-mixed, these can often be problems with stability and degradation of the solutions. Ordinarily, the photographic developers provide a problem with regard to degradation because they are readily oxidized. This is not a problem with the compositions of the above described invention because many of the dye formation inhibitors useful in the practice of that invention are antioxidants (e.g., sulfite and ascorbic acid) and their large concentrations in the solutions prevent oxidation of the developers.

One of the preferred reversing agents (color reversing agents or fogging agents) used in the practice of the invention of U.S. Ser. No. 280,263 now U.S. Pat. No. 3883354 is a borohydride or borane complex. A borane is known in the art as any compound having at least one boron-hydrogen bond. These compounds may be linear, branched, cyclic, low molecular weight, or high molecular weight as long as it contains at least one boron-hydrogen bond. Boranes are exemplified in U.S. Pat. No. 3,246,987. These boranes in the practice of the present invention must be complexed (preferably by amines) to increase their stability. The boranes may also be in the form of a borohydride to reach useful solubility by addition of a hydride ion, e.g., $BH_3 + H^- \rightarrow BH_4^-$. The complexed borane or borohydride must be of sufficient solubility to be able to put the equivalent of B-H bonds into solution as in a solution of 50 mg/1 of $KBH_4$ or 3.7 milliequivalents/liter of B-H bonds. Lower solubility than this will not enable satisfactory color reversal. Preferred compounds are inorganic borohydrides or amine stabilized complexes such as potassium borohydride and t-butyl amine borane, however, any borohydride and any complexed borane having the required miniumum solubility will work in the practice of the present invention. Borohydrides in solution are readily oxidizable and this creates problems in the commercial practice of the invention. The borohydride fogging agent is used after black-and-white development of the image-exposed photographic element. The borohydride is usually applied to the black-and-white developed color photographic element in the bath designed to remove the dye formation inhibitor. Usual photographic antioxidants, which also tend to be dye formation inhibitors cannot be used in large concentrations in the borohydride solutions as this would prevent positive dye formation after chemical fogging by the borohydride solutions so it thus becomes necessary to either find a non-inhibiting antioxidant or to add the borohydride to solution immediately prior to use.

Some borohydrides and borane complexes do not dissolve rapidly in water, and this provides a detriment to its physical addition to the inhibitor removing bath immediately prior to use. For example 60 mg of potassium borohydride dissolves in 1 l of water in about 65 seconds whereas t-butyl amine borane dissolves in about 5–6 minutes. As one of the advantages of the process is its short time cycle, any modifications which increase the time cycle without improving the results is undesirable.

It has been found in the practice of this invention that certain borohydride or borane complex pill formulations may be added to the inhibitor removing baths of the new reversal process without significant increases in the time cycle.

It has been further found in the practice of the present invention that certain borohydride or borane complex pill formulations may be used which additionally enhance the sensitometric results of the process.

The present invention relates to the use of a solid material, in the form of, for example, grains or tablets, which comprises a borohydride or borane complex physically associated or physically bonded with an aldose, to add the borohydride reversing agent to the inhibitor removing bath of the above described color positive reversal process.

The aldose is found to have two beneficial effects when added in this intimately combined fashion with the borohydride. The aldose acts as a rapid dispersing agent for the borohydride, and also beneficially effects the color balance of film developed by the process.

The aldose increases the speed of dissolution of the borohydride to a point that the combined aldoseborohydride material may be added to the inhibitor removing bath, and without stirring, the borohydride can be dissolved in the time necessary for the initial black-and-white development step of the process. Because of the small amount of borohydride or borane complex used in the disclosed development process, the dilution of this material in the aldose simplifies measurment of quantities to be used in the wash bath compositions. A preferred range for the compositions of this invention is from 0.074 milli-equivalents BH/1000 g aldose to 0.074 milli-equivalents BH/5g aldose. The presence of cornstarch, which physically secures the materials also aids in the rapidity of dissolution of the compacted materials.

Any aldose material as that term is understood in the art will function in the practice of the present invention.

The following examples will further illustrate the practice of the present invention. In all examples, the following procedures were used:

Color reversal film was exposed on a densitometer with a continuous wedge (density 0-4). The film was developed according to he process of U.S. Ser. No. 280,263. The film was immersed for 3.5 minutes in the following solution:

| | | |
|---|---|---|
| hydroquinone | 6.0 g | |
| phenidone | 0.3 g | |
| sodium sulfite | 48.0 g | |
| sodium carbonate | 30.0 g | |
| Potassium bromide | 2.0 g | |
| potassium iodide | 0.1 g | |
| sodium thiocyanate | 0.5 g | |
| CD-4 | 28.0 g* | |
| calgon | 2.0 g | |
| water to | 1 liter | |
| ph to | 10.2 | by dropwise addition of a 20% by weight solution of NaOH |

*[CD-4 is 3-methyl-4-amino-N-ethyl-N hydroxyethylaniline sulfate]

The film was then superficially water washed for 5 seconds, then immersed in the following inhibitor removing bath:

| | | |
|---|---|---|
| sodium sulfite | 0.1 g | |
| trisodium phosphate | 4.0 g | |
| potassium bromide | 1.0 g | |
| ethylene diamine | 15.0 ml | |

-continued

| | | |
|---|---|---|
| potassium iodide | 0.01 g | |
| water to | 1 liter | |
| Ph to | 12.2 | by dropwise addition of 20% by weight sodium hydroxide solution |

The reversing agent in all examples was added to this inhibitor removing bath by adding the hereinafter described pellets and then stirred for 1 min. In this first example, only 0.06 g t-butylamine borane was used. No aldose was present.

After fixing thiosulfate solution — standard type, with an aqueous solution comprising 17.6% of a 60% by weight ammonium thiosulfate solution and 1.8% potassium metabisulfite and glacial acetic acid to ph 6, and then water washing, the following data was obtained:

| CURVE 819 | FOG | DMAX | γTOE | γMEAN |
|---|---|---|---|---|
| Red Filter (cyan dye layer) | .21 | 3.14 | .96 | 2.00 |
| Green filter (magenta dye layer) | .27 | 2.64 | 1.06 | 2.30 |
| Blue filter (yellow layer) | .25 | 3.88 | 1.16 | 2.12 |

We repeated the experiment except we used potassium borohydride (50 mg) and hydrazine (25 μl) in place of the t-butylamine borane in the second bath. Sensitometry readings in this second case were:

| CURVE 819h | FOG | DMAX | γTOE | γMEAN |
|---|---|---|---|---|
| Red filter | .22 | 3.30 | 1.04 | 1.98 |
| Green filter | .26 | 2.96 | 1.20 | 2.20 |
| Blue filter | .24 | 3.60 | 1.03 | 2.20 |

A third experiment was conducted in which the reversing agent used was potasium borohydride (100 mg).

| Sensitometry readings were: | FOG | DMAX | γTOE | γMEAN |
|---|---|---|---|---|
| Red filter | .18 | 3.20 | 1.00 | 2.20 |
| Green filter | .27 | 3.00 | 0.98 | 2.20 |
| Blue filter | .24 | 3.50 | 0.98 | 2.30 |

The primary difference in these reversing agents is in the effect on the magenta dye layer. This imbalance is evidenced in the low green filter reading for maxiumum density in the film reversed with t-butyl-amine borane. Net result is a green cast or stain in the film. We noted, also, that after seven days the reversing agent in film is gone. The densitometry curves decrease in density at lower exposures. (Exactly opposite to what should occur).

The other important component in the practice of this invention is the aldose. It serves to act as a fast dispersing agent for the borane and it also enables handling a large volume of material which contains a small amount of an active ingredient. Only milligram quantitities of the reversing agent are needed and it would be difficult to measure these small quantities and transfer them quantitatively in pure form. By blending the agent with the aldose, we can measure gram amounts of solid, with error in dispersal of less than 5%. Since it is very soluble in water, the aldose physically aids dissolving of the borane in a matter of one minute.

The aldose also affects the color balance of the film. This effect is evident from densitometry data on films developed with and without aldoses added to the inhibitor removing bath.

| CONTROL-NO ALDOSE | FOG | DMAX | γTOE | γMEAN |
|---|---|---|---|---|
| Red filter | .13 | 3.46 | 1.47 | 2.50 |
| Green filter | .18 | 3.25 | 1.67 | 2.75 |
| Blue filter | .20 | 3.93 | 1.27 | 2.58 |
| REPEAT WITH 8 GM LACTOSE/1 | FOG | DMAX | γTOE | γMEAN |
| Red filter | .17 | 3.48 | 1.19 | 2.45 |
| Green filter | .18 | 3.20 | 1.37 | 2.51 |
| Blue filter | .18 | 3.77 | 1.07 | 2.35 |
| In a second series, results were: CONTROL-NO ALDOSE | FOG | DMAX | γTOE | γMEAN |
| Red filter | .20 | 2.70 | .84 | 1.59 |
| Green filter | .28 | 3.02 | 1.15 | 2.00 |
| Blue filter | .22 | 3.12 | 1.02 | 2.00 |
| WITH 21 GM/1 SUCROSE | FOG | DMAX | γTOE | γMEAN |
| Red filter | .20 | 2.92 | .74 | 1.57 |
| Green filter | .30 | 3.10 | 1.03 | 2.02 |
| Blue filter | .24 | 3.22 | .94 | 2.08 |

The effect of aldose is in the toe contrast areas; in all cases, the aldose lowered the toe contrast. Apparent reduction in overall contrast is not consistent, but an overall improvement in color balance in the film is apparent. We measured the difference in exposure for the three dye layers at a density of 0.5 to show this improvement. In order to have the best skin tones in Ektachrome X film, the blue filter reading (yellow dye layer) should take a lower exposure than the green filter (magenta dye layer), and they should be very close to the same exposure. The red filter reading (cyan dye layer) should take more exposure than the green but again, they should be very nearly the same. In the actual case, adding 21 gm/l. of sucrose changed the difference between the blue and green filter reading from −0.13 to −0.01. The difference between the red-green filter reading changed only from 0.01 to 0.02.

In addition to the two important acting ingredients, the borohydride and the aldose, other photographic chemical additions or inert materials, such as lubricants to help processing of the pellets, and dispersants to aid in pellet break-up can be present.

EXAMPLE

Single dose pellets for use in the practice of the practice of the invention were made as follows:

0.3 g magnesium stearate, 2.0 g corn starch, 3.0 g potassium borohydride, and 94.7 g of lactose were added into a dry powder blender. The powder mixture was tumbled well until the materials were evenly mixed (about 15 minutes).

The powder was then added into the feed chamber of a standard pharmaceutical tablet maker. The tablet maker settings were adjusted so that 200 mg of powder were used for each tablet. The powder was compacted into a pellet which provided 6.0 mg of borohydride, an amount quite satisfactory for use in 100 ml inhibitor removing bath.

What is claimed is:

1. A composition of matter comprising a borohydride or borane complex anhydrously associated with an aldose.

2. The composition of claim 1 wherein the composition is compacted.

3. The composition of claim 2 wherein the composition is in pellet form.

4. The composition of claim 1 wherein the borane complex or borohydride is selected from inorganic borohydrides or amine stabilized complexes.

5. The compositon of claim 4 wherein the inorganic borohydride is an alkali metal borohydride.

6. The composition of claim 4 wherein the amine stabilized complex is t-butyl amine borane.

7. The composition of claim 1 wherein the ratio of borohydride or borane complex to aldose is from 0.074 milli-equivalents BH/1000g aldose to 0.074 milli-equivalents BH/5g aldose.

* * * * *